US005518231A

United States Patent [19]

Reddy

[11] Patent Number: 5,518,231

[45] Date of Patent: May 21, 1996

[54] SELF ADJUSTING SHEET GRIPPING APPARATUS

[75] Inventor: Karimireddy H. Reddy, East Rochester, N.Y.

[73] Assignee: Xerox Corporation, Stamford, Conn.

[21] Appl. No.: 47,530

[22] Filed: Apr. 19, 1993

[51] Int. Cl.[6] ..... B65H 5/02; B65H 5/04; G03G 21/00

[52] U.S. Cl. ..... 271/277; 271/82; 271/204; 294/119.3; 355/309; 355/317

[58] Field of Search ..... 355/274, 271, 355/275, 281, 309, 312, 326 R, 290; 271/277, 204, 206, 82, 94; 198/468.2, 470.1, 803.7; 101/408–411; 400/625, 627, 636, 636.3, 645; 294/119.3

[56] References Cited

U.S. PATENT DOCUMENTS

| | | | |
|---|---|---|---|
| 4,155,305 | 5/1979 | Heissler et al. | 101/408 |
| 4,497,482 | 2/1985 | Furze et al. | 271/94 |
| 4,629,176 | 12/1986 | Ceelen | 271/204 |
| 5,128,726 | 7/1992 | Cassano et al. | 355/308 |
| 5,276,493 | 1/1994 | Hediger et al. | 355/290 |

FOREIGN PATENT DOCUMENTS

| | | | |
|---|---|---|---|
| 1-018666 | 1/1989 | Japan | 400/627 |
| 0770789 | 10/1980 | U.S.S.R. | 294/119.3 |

*Primary Examiner*—Arthur T. Grimley
*Assistant Examiner*—Shuk Y. Lee
*Attorney, Agent, or Firm*—Don L. Webber

[57] ABSTRACT

An apparatus for gripping a sheet includes a first gripping member and a second gripping member, one or both of which are equipped with one or more inflatable self adjusting gripper pads or tubes. The inflatable gripper pad provides a more efficient, reliable and cost effective method for the first gripping member and the second gripping member to cooperate together so as to releasably grip a sheet in a printing or copying machine. A spring and cam following system may be used to move the first gripping member in relation to the second gripping member. A mechanical or electromechanical pump may be used to inflate and deflate the inflatable gripper pads so as to provide the gripping action on the sheet or so as to vary the gripping pressure created by a spring and cam system. The self adjusting inflatable gripper pads of the present invention permit a uniform force distribution or pressure to be applied along the entire length of the sheet grasping nip formed by the first gripping member and the second gripping member.

15 Claims, 11 Drawing Sheets

SELF ADJUSTING SHEET GRIPPING APPARATUS

The present invention relates generally to an apparatus for gripping a sheet and, more particularly, concerns a self adjusting inflatable member for gripping the leading edge of a sheet so that it may be pulled through the sheet path of a copying or printing machine.

Sheet grippers of various designs are commonly used in copying and printing machines, and most frequently operate by gripping the leading edge of a sheet as it is transported through the machine. The sheet gripper must reliably and readily access the sheet, and must maintain a firm grip without slippage on the sheet throughout the entire processing and transport cycle. Once the sheet has been fully processed through the sheet gripper station, the sheet is released and the sheet gripper prepares to accept and transport the next sheet.

Multicolor copiers and printers often employ a gripper assembly having a set of jaws to pull a sheet along a track for the multiple pass cycles utilized to the complete the copy or print. Present gripper assemblies commonly employ two jaws that grasp the sheet; one or more springs generally provide the requisite sheet gripping force. The opening and closing of the jaws may be actuated by one or more cam lifters positioned around the sheet movement track or by similar means. A uniform gripping force or pressure should desirably be maintained along the entire nip (the points where the gripper assembly jaws meet the sheet being gripped), to prevent the sheet from shifting between the jaws of the sheet gripper as it is transported. Any failure by the jaws to maintain a firm hold on the sheet can cause machine jamming or failure, or may result in inferior print and image quality.

Sheet transport failures can originate from a wide variety of sources, to include operating conditions, manufacturing tolerances and others. The onset of even minor slippage or skew in the sheet will cause highly visible misregistration of the different colors in a multiple pass color system, and can cause a variety of other undesirable consequences in single or multiple pass copier and printer systems. Sheet grippers may also fail as a result of equipment wear and tear, operating environment variances, material handling situations and other causes. Further, a significant percentage of sheet grippers of known designs may be produced only to be rejected for failing to meet a relatively strict set of manufacturing tolerances that must be adhered to. At present, machining of the jaws of such sheet grippers is necessary to achieve the requisite sheet gripper performance, resulting in higher production costs, metal waste caused by milling and higher production error rates, and a weakened gripper assembly structure as a result of the necessary reshaping of the metal parts.

Various approaches have been employed for gripping a sheet to be transported in a copying or printing machine, including the following disclosures that may be relevant:

U.S. Pat. No. 4,155,305

Patentee: Heissler et al.

Issued: May 22, 1979

U.S. Pat. No. 5,128,726

Patentee: Cassano et al.

Issued: Jul. 7, 1992

U.S. Pat. No. 4,629,176

Patentee: Ceelen

Issued: Dec. 16, 1986

U.S. Pat. No. 4,155,305 discloses a bending resistant gripper carriage structure for use in offset printing machines that includes an impact strip. The gripper carriage includes a fiber sandwich construction, intended to resist deformation resulting from the speed of operation and the various forces acting on such gripper carriages.

U.S. Pat. No. 5,128,726 discloses a sheet gripper that includes a silicon or like coating on an inner (gripping) surface of a sheet gripper jaw.

U.S. Pat. No. 4,629,176 discloses a paper gripper that includes upper and lower portions made from extruded aluminum for providing stiffness to the gripper assembly, and a set of spring clips for biasing the upper and lower portions in a closed position.

In accordance with one aspect of the present invention, there is provided an apparatus for releasably gripping an edge of a sheet, comprising a gripping member having opposed surfaces movable relative to one another. The opposed surfaces operate to secure and release the edge of the sheet. The apparatus includes a means, operatively associated with the gripping member, for applying a substantially uniformly distributed force along the edge of the sheet in response to the sheet being secured by the gripping member.

Other aspects of the present invention will become apparent as the following description proceeds and upon reference to the drawings, in which.

Figure 1:
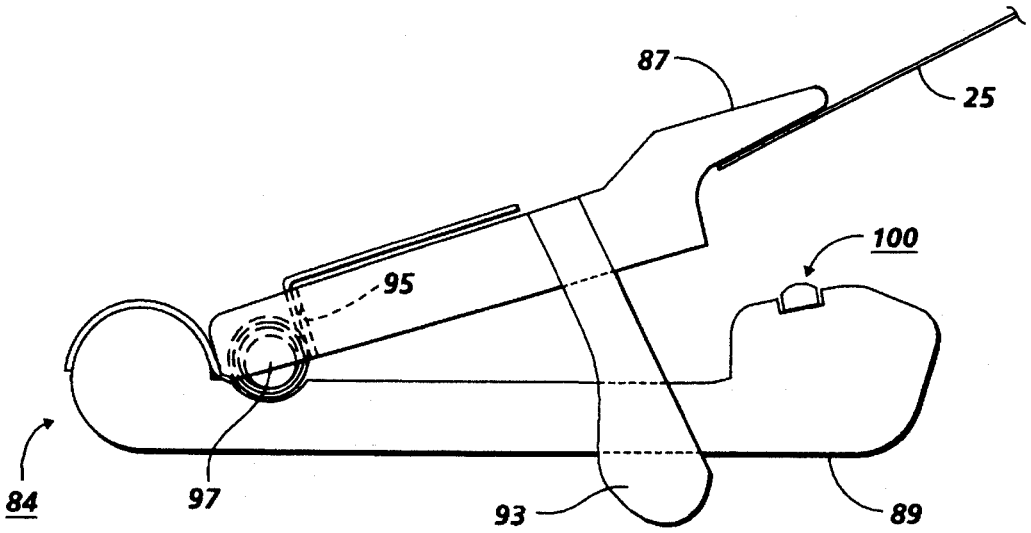
FIG. 1 is a schematic elevational view of the gripping portions of the sheet gripper of the sheet transport system used in an electrophotographic printing machine, with the sheet gripper in the open position and further showing a sheet within the gripping nip.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like references have been used throughout to designate identical elements. It will become evident from the following discussion that the present invention and the various embodiments set forth herein are suited for use in a wide variety of printing and copying systems, and are not necessarily limited in its application to the particular systems shown herein.

Figure 13:
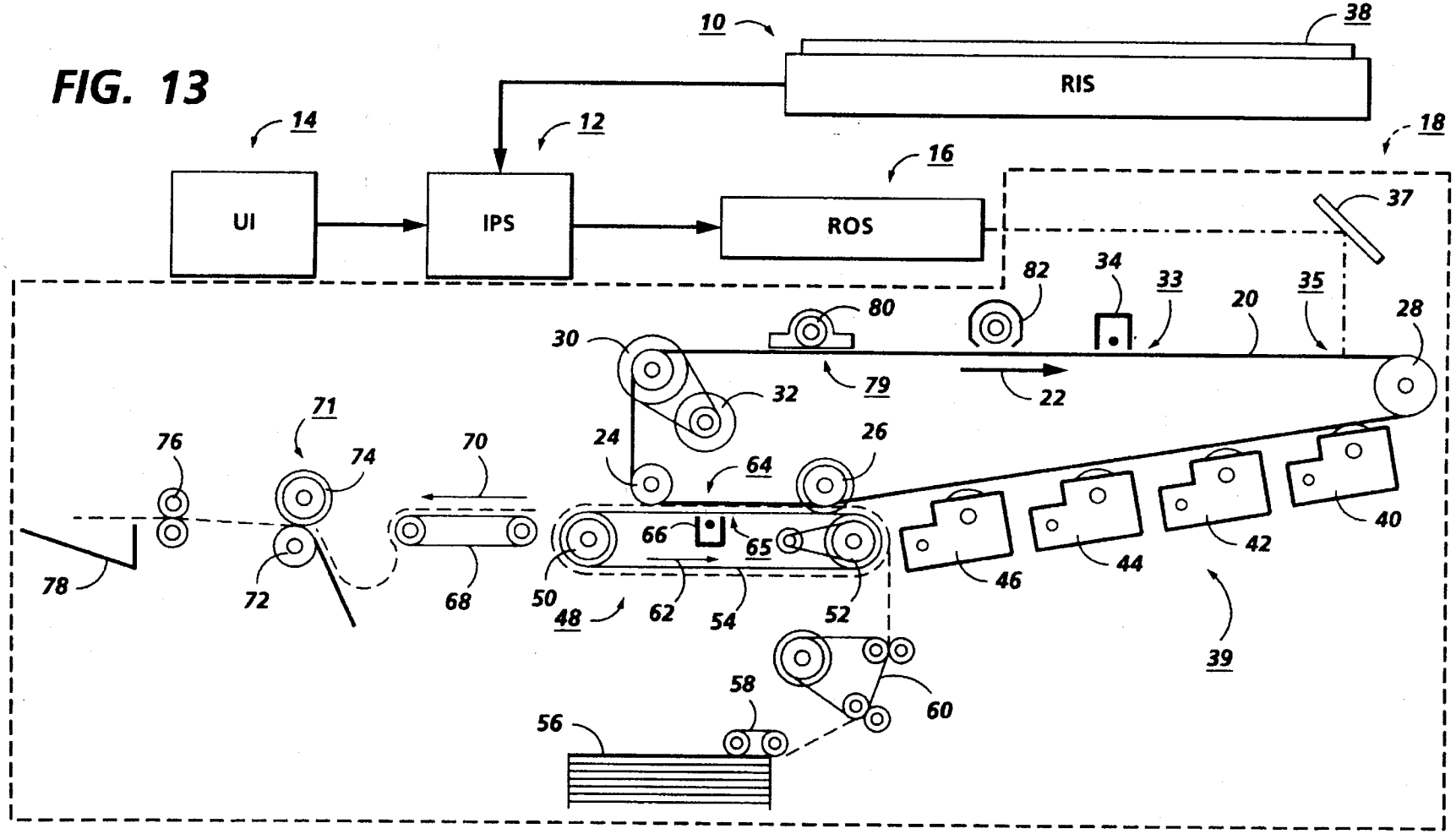
FIG. 13 is a schematic elevational view showing an examplary electrophotographic printing machine which may incorporate the features of the present invention therein.

FIG. 13 is a schematic elevational view showing an electrophotographic printing machine which may incorporate features of the present invention therein. It will become evident from the following discussion that the present invention is equally well suited for use in a wide variety of printing systems, and is not necessarily limited in its application to the particular system shown herein. As shown in FIG. 13, during operation of the printing system, a multiple color original document 38 is positioned on a raster input scanner (RIS), indicated generally by the reference numeral 10. The RIS contains document illumination lamps, optics, a mechanical scanning drive, and a charge coupled device (CCD array). The RIS captures the entire image from original document 38 and converts it to a series of raster scan lines and moreover measures a set of primary color densities, i.e. red, green and blue densities, at each point of the original document. This information is transmitted as electrical signals to an image processing system (IPS), indicated generally by the reference numeral 12. IPS 12 converts the set of red, green and blue density signals to a set of colorimetric coordinates. The IPS contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The operator actuates the appropriate keys of UI 14 to adjust the parameters of the copy. UI 14 may be a touch screen, or any other suitable control panel, providing an operator interface with the system. The output signal from UI 14 is transmitted to IPS 12. The IPS then transmits signals corresponding to the desired image to ROS 16, which creates the output copy image. ROS 16 includes a laser with rotating polygon mirror blocks. Preferably, a nine facet polygon is used. The ROS illuminates, via mirror 37, the charged portion of a photoconductive belt 20 of a printer or marking engine, indicated generally by the reference numeral 18, at a rate of about 400 pixels per inch, to achieve a set of subtractive primary latent images. The ROS will expose the photoconductive belt to record three latent images which correspond to the signals transmitted from IPS 12. One latent image is developed with cyan developer material. Another latent image is developed with magenta developer material and the third latent image is developed with yellow developer material. These developed images are transferred to a copy sheet in superimposed registration with one another to form a multi-colored image on the copy sheet. This multi-colored image is then fused to the copy sheet forming a color copy.

With continued reference to FIG. 13, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform potential.

Next, the charged photoconductive surface is rotated to an exposure station, indicated generally by the reference numeral 35. Exposure station 35 receives a modulated light beam corresponding to information derived by RIS 10 having multi-colored original document 38 positioned thereat. The modulated light beam impinges on the surface of photoconductive belt 20. The beam illuminates the charged portion of the photoconductive belt to form an electrostatic latent image. The photoconductive belt is exposed three times to record three latent images thereon.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is substantially adjacent the photoconductive belt, while in the nonoperative position, the magnetic brush is spaced therefrom. In FIG. 13, developer unit 40 is shown in the operative position with developer units 42, 44 and 46 being in the nonoperative position. During development of each electrostatic latent image, only one developer unit is in the operative position, the remaining developer units are in the nonoperative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper 84 (not shown in FIG. 13) extends between belts 54 and moves in unison therewith. A sheet 25 is advanced from a stack of sheets 56 disposed on a tray. A friction retard feeder 58 advances the uppermost sheet from stack 56 onto a pretransfer transport 60. Transport 60 advances sheet 25 (not shown in FIG. 13) to sheet transport 48. Sheet 25 is advanced by transport 60 in synchronism with the movement of the sheet gripper. In this way, the leading edge of sheet 25 arrives at a preselected position, i.e. a loading zone, to be received by the open sheet gripper. The sheet gripper then closes securing sheet 25 thereto for movement therewith in a recirculating path. The leading edge of sheet 25 is secured releasably by the sheet gripper. As belts 54 move in the direction of arrow 62, the sheet moves into contact with the photoconductive belt, in synchronism with the toner image developed thereon. In transfer zone 64, a gas directing mechanism 100 directs a flow of gas onto sheet 25 to urge the sheet toward the developed toner image on photoconductive member 20 so as to enhance contact between the sheet and the developed toner image in the transfer zone. Further, in transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another.

One skilled in the art will appreciate that the sheet may move in a recirculating path for four cycles when under color black removal is used. Each of the electrostatic latent images recorded on the photoconductive surface is developed with the appropriately colored toner and transferred, in superimposed registration with one another, to the sheet to form the multicolor copy of the colored original document.

After the last transfer operation, the sheet transport system directs the sheet to a vacuum conveyor 68. Vacuum conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 14:
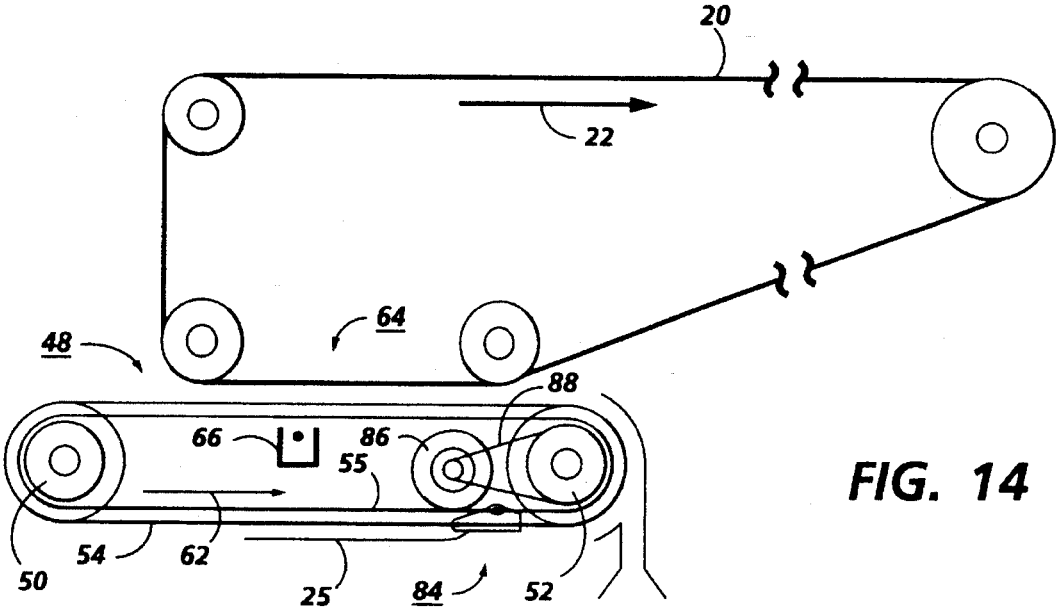
FIG. 14 is a schematic elevational view showing further details of the sheet transport system used in the electrophotographic printing machine of FIG. 13.
Figure 15:
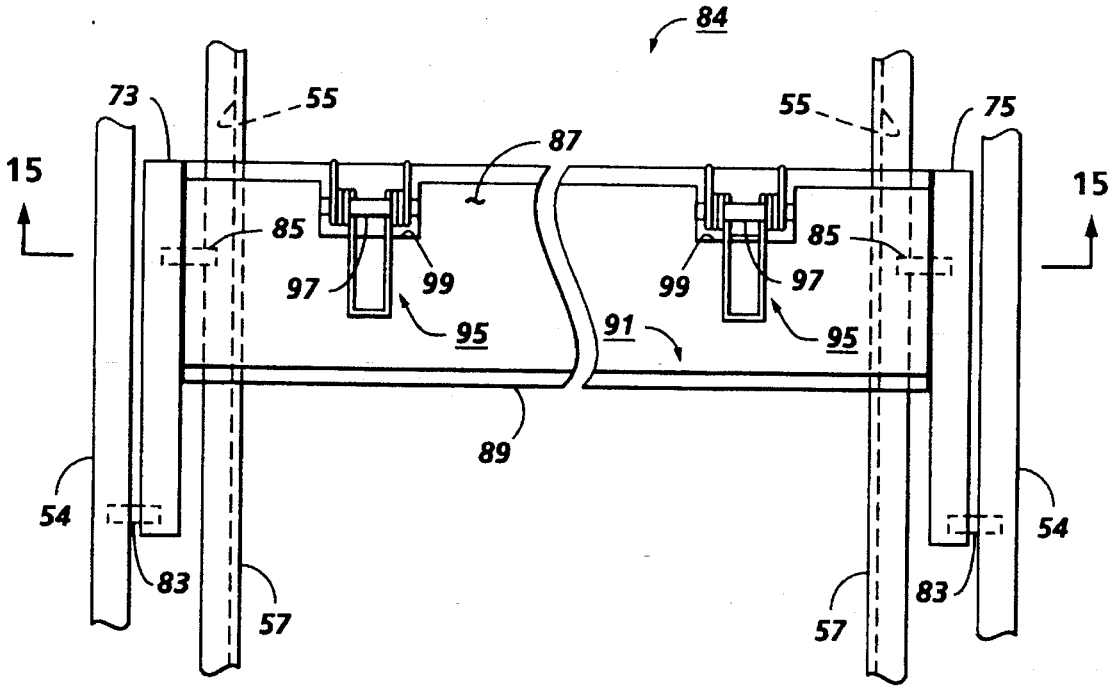
FIG. 15 is a schematic planar view showing the sheet gripper of the sheet transport system used in the electrophotographic printing machine of FIG. 13.
Figure 16:
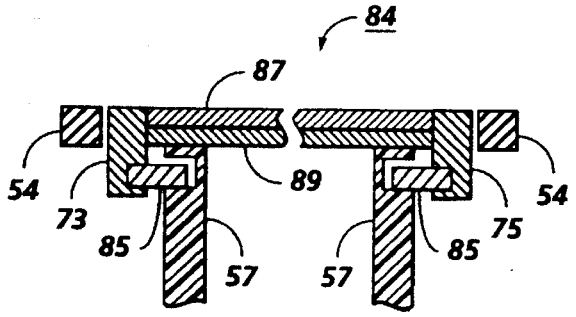
FIG. 16 is a sectional elevational view, taken along the lines in FIG. 15 in the direction of the arrows, of the opposed side marginal regions of a sheet gripper.

FIG. 14 shows sheet gripper 84 of sheet transport 48 for transporting sheet 25 (not shown) in the direction of arrow 62 in a recirculating path of movement. FIG. 15 shows sheet gripper 84 suspended between two spaced apart timing belts 54. FIG. 16 shows a sectional elevational view, taken along the lines in FIG. 15 in the direction of the arrows, of the opposed side marginal regions of sheet gripper 84. Referring to FIGS. 14–16, timing belts 54 are mounted on rollers 50 and 52. Belts 54 define a continuous path of movement of sheet gripper 84. A motor 86 is coupled to roller 52 by a drive belt 88. Sheet gripper 84 includes a pair of guide members 85. A pair of spaced apart and continuous tracks 55 are respectively positioned substantially adjacent belts 54. Tracks 55 are respectively defined by a pair of track supports 57. Each of guide members 85 are slidably positioned within a respective track 55. As shown in FIG. 15, belts 54 are respectively connected to gripper supports 73 and 75 by a pair of pins 83. The belts are connected to the sheet gripper behind the leading edge of sheet 25 relative to the forward direction of movement of belts 54, as indicated by arrow 62 (FIG. 14), when sheet 25 is being transported by sheet transport 48. The sheet gripper is driven by the belts at the locations where the sheet gripper and the belts are connected.

Sheet gripper 84 further includes an upper gripping portion 87 and a lower gripping portion 89 which are biased toward each other by a plurality of springs, each being generally indicated by the reference numeral 95 (see FIGS. 15 and 16). Gripping portions 87 and 89 are respectfully connected to a pair of gripper supports 73 and 75 as shown in FIGS. 15 and 16. A plurality of securing pins 97 are respectively positioned within apertures 99 of up per gripping portion 87 and secured thereto to hold springs 95 in place so as to bias upper gripping portion 87 toward lower gripping portion 89.

The sheet gripper may further include a pair of cam followers (not shown) which are attached to the opposed side marginal regions of upper gripping portion 87 and function with a pair of cams (not shown) to open and close the gripping portions at predetermined intervals.

Figure 17:
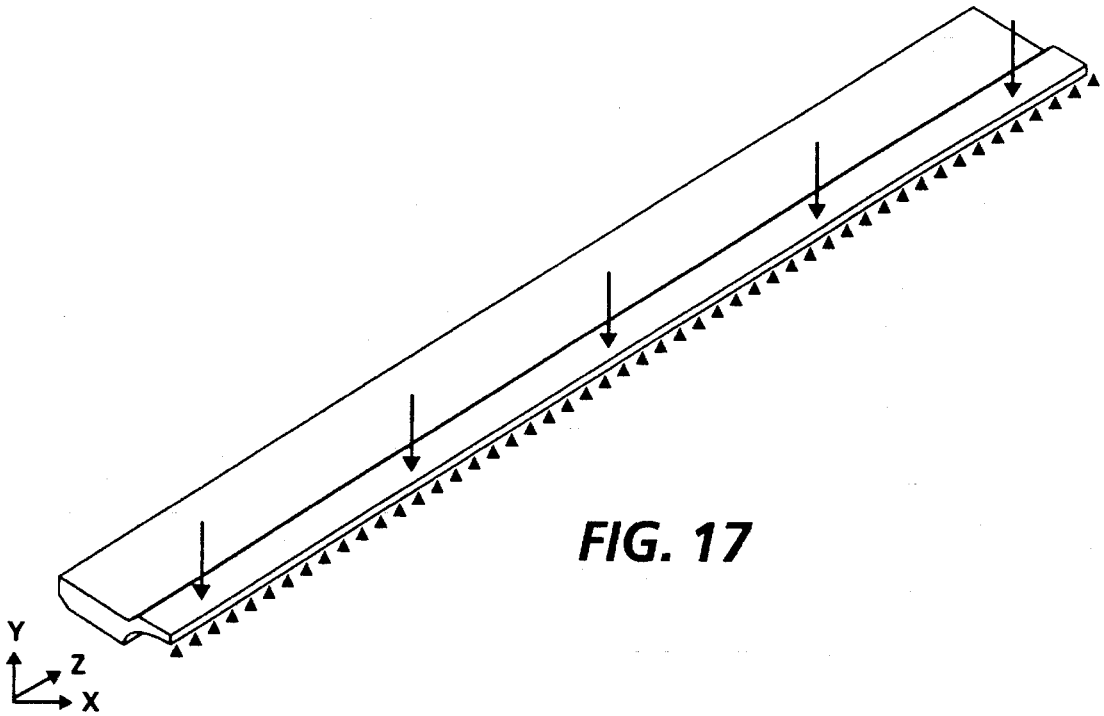
FIG. 17 is a theoretical illustration of "nodal" or point gripping forces present along the nip of an upper jaw of a conventional sheet gripper.
Figure 18:
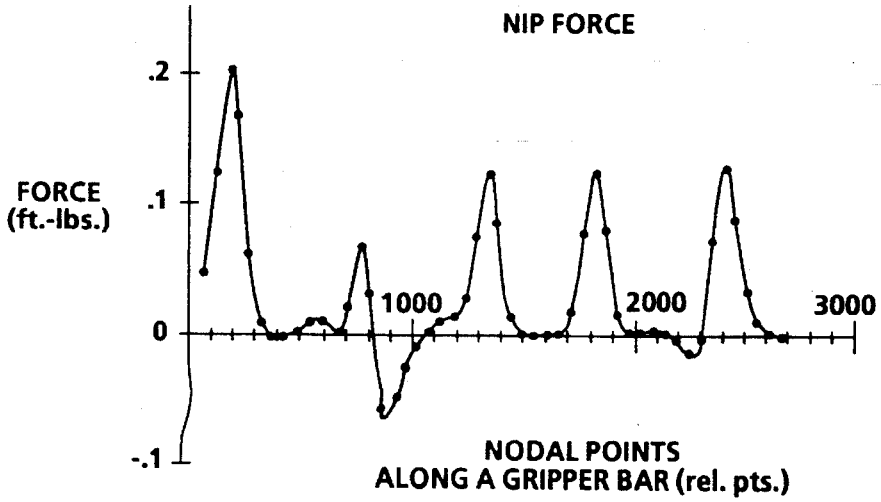
FIG. 18 is a graph showing a theoretical representation of the gripping forces present on an upper jaw of a sheet gripper.

FIG. 17 is a theoretical illustration of a set of "nodal" or point gripping forces that might be present at any particular point along the nip of the upper gripper portion of a conventional sheet gripper. The graph of FIG. 18 provides a theoretical representation of the nodal gripping forces as they might exist along an upper gripper portion shown in FIG. 17. The five peaks of the graph in FIG. 18 correspond to the five force arrows on FIG. 17, as might be present when a set of five gripper springs is used in a sheet gripper assembly. FIG. 18 demonstrates that as expected, the highest nodal point forces as would be found at the location of five gripper springs along the nip of a sheet gripper, and that distortion and point loading along a gripper nip will result in nonuniform pressure along that nip. A self adjusting system, such as the fluid filled gripper pad(s) of the present invention will provide a uniform pressure along the entire nip of a gripper assembly, resulting in a more reliable assembly. Deformation of the gripper assembly jaws, point spring loading (as shown in FIGS. 17 and 18) and a variety of other manufacturing and operational wear conditions can lead to sheet gripper assembly failures that can be achieved with the present invention If a uniform pressure along the nip can be achieved (as would be represented by a horizontal pressure line, in contrast to the uneven force distribution shown by FIG. 18), gripper assembly reliability and performance can be enhanced, and production costs can be significantly reduced. Achieving this desired uniform pressure along the nip can also reduce the total spring or other gripping force required at the nip, further reducing machine wear and costs. As such, the benefits of achieving a uniform pressure along the entire nip using a durable, self adjusting system include improved assembly life, less stringent sheet gripper manufacturing tolerances, and other important cost reductions and reliability improvements over known sheet grippers.

Figure 2:
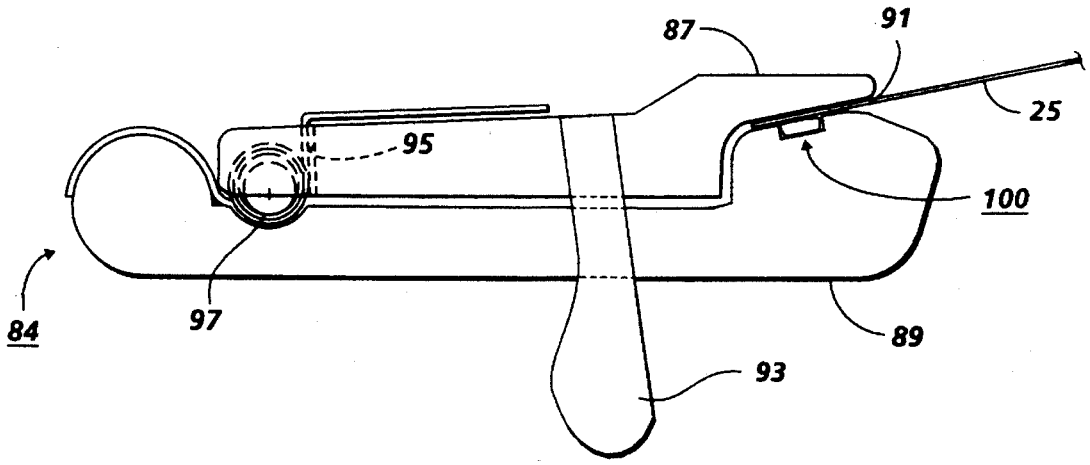
FIG. 2 is a schematic elevational view of the gripping portions of the sheet gripper of the sheet transport system used in an electrophotographic printing machine, with the sheet gripper in the closed position and further showing a sheet secured within the sheet gripper.

FIGS. 1 and 2 are two embodiments of the sheet gripper of the present invention, generally positioned as is sheet gripper assembly 84 as is shown in FIGS. 14 and 15. As a point of reference, FIGS. 1 and 2 show a partial cross section of an embodiment of the present invention enlarged 5 or more times over known sheet grippers employed in single and multi-pass copying and printing machines. One can thus appreciate the need for the fine parts of known grippers to be precisely machined yet extremely durable. FIG. 1 shows the orientation of upper gripping portion 87 relative to lower gripping portion 89 in sheet gripper 84 when cam follower 93 is actuated to overcome the bias of springs 95. FIG. 2 shows the orientation of upper gripping portion 87 relative to lower gripping portion 89 when cam follower 93 is moved to a nonactuated position. Cam follower 93 (and the cam follower at the opposite end of the gripper assembly, not shown) is in this position when they are not in contact with the cams. When gripper assembly 84 is in the closed position, upper gripping portion 87 cooperates with lower gripping portion 89 to grasp and securely hold the leading edge of sheet 25. The area at which the gripping portions 87 and 89 grasp sheet 25 defines a gripping nip, generally indicated by the reference numeral 91 (see FIGS. 15 and 2). Positioned upon lower gripping portion 89, near gripping nip 91, is a fluid filled gripper pad 100 (see FIGS. 1–2). With fluid filled elastomeric gripper pad 100 positioned as set forth above, a self adjusting uniform pressure is applied on sheet 25 between the gripping portions. As with other embodiments of the present invention shown and described herein, the gripper pads may be pre-pressurized with fluid prior to installation, or pressurized after installation in the copier or printing machine. The embodiment of FIGS. 1 and 2 may be mounted in the same manner as sheet gripper 84 as shown in FIG. 15.

Figure 3:
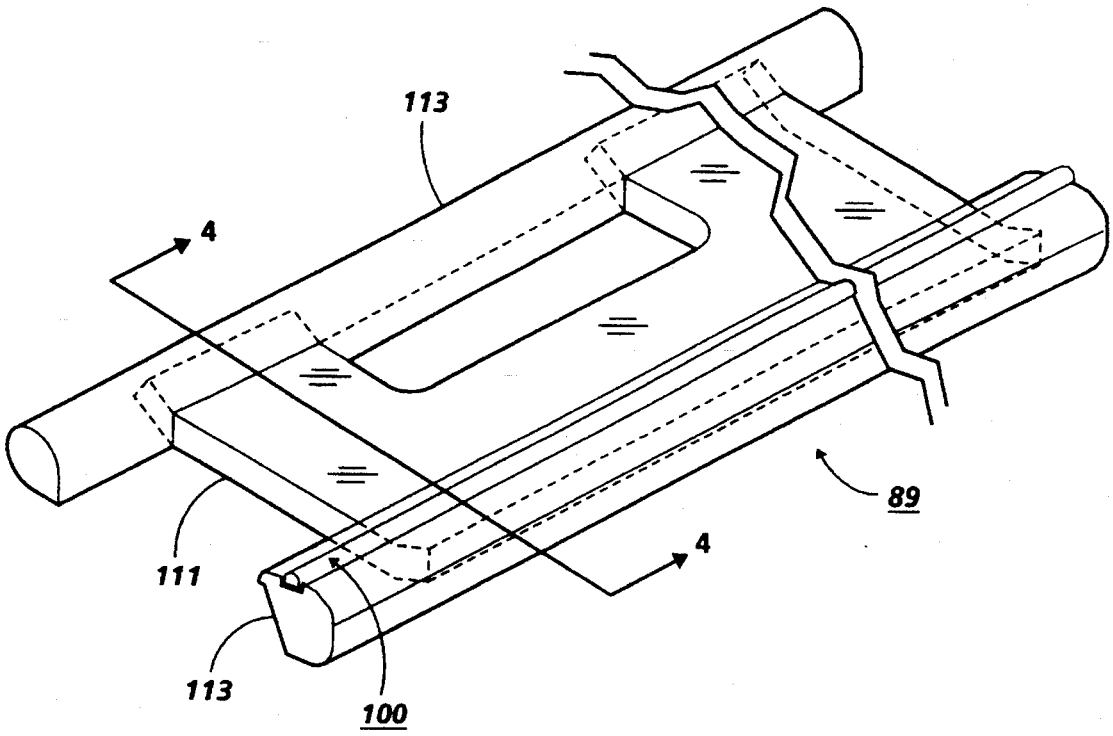
FIG. 3 is a perspective view of the lower gripping portion of the gripping member.

FIG. 3 shows a partial perspective view of further details of a lower gripping portion 89. More specifically, the lower gripping portion includes a central core 111, preferably comprised of steel sheet metal, as self adjusting gripper pad 100 can eliminate the need to machine upper and lower gripper portions 87 and 89 to the precise tolerances required with known gripper assemblies. As such, central core 111 and other parts of the gripper assembly may be formed using metal stamping or other less costly material forming methods, so as to eliminate the costs of machining. Due to the self-adjusting nature of the inflated/pressurized gripper pads, manufacturing tolerances of many of the components to various embodiments of the gripper assembly may be relaxed, resulting in lower costs, less waste and more durable sheet grippers. Increased structural strength of the gripper assembly may also result from the use of unmachined metal. Lower gripping portion 89 may further include a cast substance 113 secured to central core 111. The cast substance is cast into a desired shape on opposite end portions of central core 111 and is thus secured thereto as shown in FIG. 3. The fluid filled gripper pad 100 is positioned on the sheet contact side of cast substance 113 (see FIGS. 1–3). Another fluid filled gripper pad (not shown) may be mounted on upper gripper portion 87, opposite gripper pad 100 on lower gripper portion 89. A pressure valve or pump (not shown) may be used to vary the internal pressure of gripper pad 100, and can thereby vary the pressure on the edge of sheet 25 as it is gripped between gripping portions 87 and 89.

Figure 4:
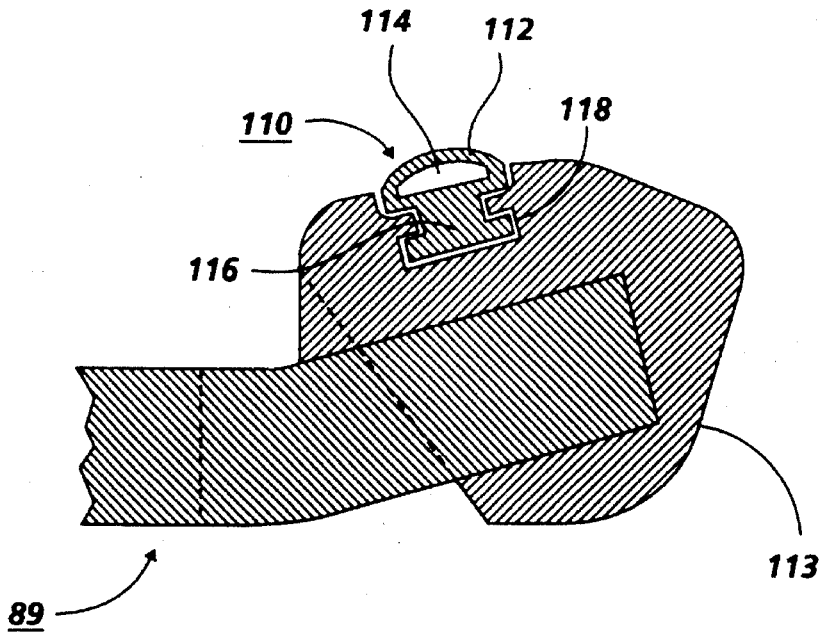
FIG. 4 is an enlarged sectional, elevational view along the line 4—4 of FIG. 3 in the direction of the arrows of another embodiment of a lower gripping portion.

FIG. 4 shows another embodiment of a gripper pad as may be used on a lower gripping portion 89. Gripper pad 110 is shown with sheet contact surface 112 and fluid chamber 114. Gripper pad 110 is attached in dovetail fashion to lower gripper portion 89, with locking portion 116 of gripper pad 112 inserted into locking channel 118 of lower gripper portion 89.

Figure 5:
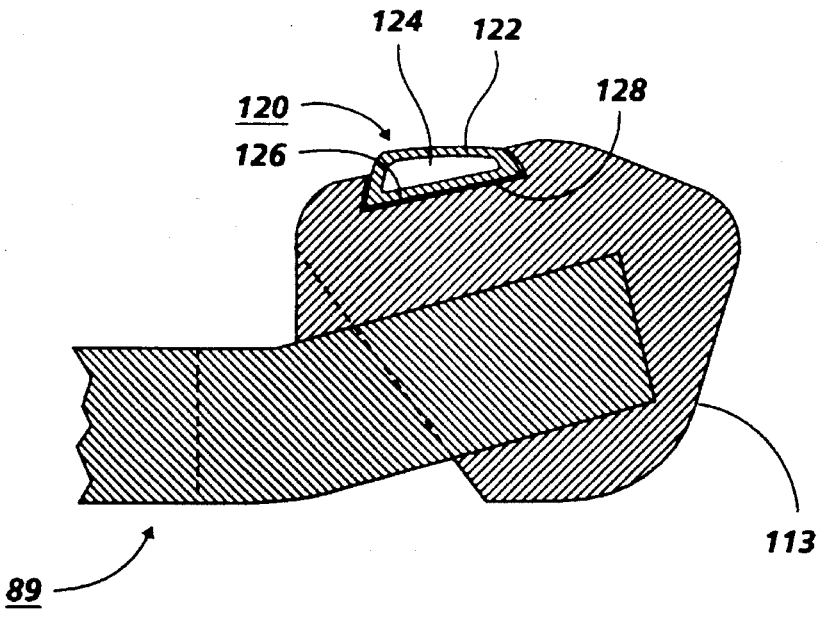
FIG. 5 is an enlarged sectional, elevational view along the line 4—4 of FIG. 3 in the direction of the arrows of another embodiment of a lower gripping portion.

FIG. 5 shows another embodiment of a gripper pad 120 of a sheet contact surface 122 of gripper pad 120 provided a wider gripping surface so as to maintain enhanced and well distributed pressure on an adjacent sheet. An elongated fluid chamber 124 provides the desired self adjusting dispersion of pressure as applied by contact surface 122 on an adjacent sheet. Flared base 126 of gripper pad 120 interlocks with channel 128 of lower gripper portion 89 to insure gripper pad 120 remains in position. Flared base 126 may include a rigid stiffener to prevent gripper pad 120 from becoming dislodged from channel 128.

Figure 6:
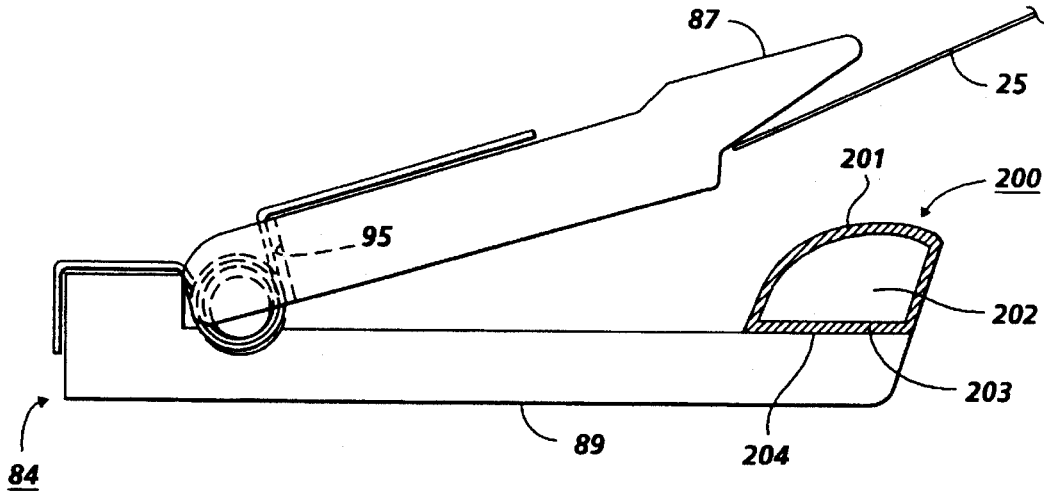
FIG. 6 is a side elevational view, partially in section, of the gripping portions of another embodiment of the sheet gripper in the open position.
Figure 7:
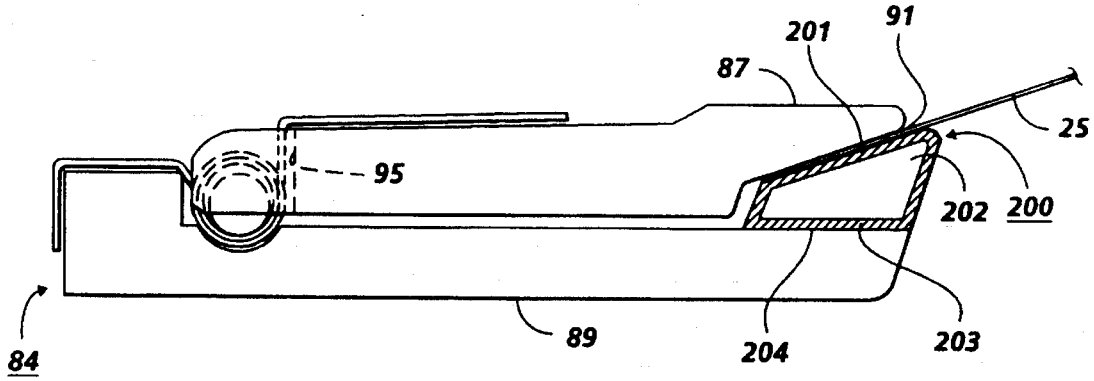
FIG. 7 is a side elevational view, partially in section, of the gripping portions of the sheet gripper shown in the closed position and further showing a sheet being grasped by the sheet gripper.

FIGS. 6 and 7 show another embodiment of the present invention. FIG. 6 shows the orientation of upper gripping portion 87 relative to lower gripping portion 89 when the cam followers are moved to a nonactuated (closed jaw) position. FIG. 7 shows the orientation of upper gripping portion 87 relative to lower gripping portion 89 when the cam followers are moved to an actuated (open jaw) position. Fluid filled elastomeric member 200 is positioned along lower gripping portion 89, having an outwardly biased sheet contact surface 201. When upper gripping portion 87 and lower gripping portion 89 are in the closed position as shown in FIG. 6, outwardly biased sheet contact surface 201 of fluid filled elastomeric member 200 is compressed by the biasing force of springs 95, thereby insuring a uniform pressure and firm frictional grip on sheet 25. In both FIGS. 4 and 5, chamber 202 maintains the fluid inside gripper pad 200; lower surface 203 of gripper pad 200 is affixed by any number of means (adhesive, heat seal and/or tongue and grove as shown in FIGS. 4 and 5) so as to remain in position on gripper pad mounting surface 204 of lower gripping portion 89.

While certain aspects of sheet gripper 84 as shown in FIGS. 1–7 have not been described in detail, it will be understood that the upper gripping portion 87 may be equipped with a gripper pad in a manner similar to that of lower gripping portion 89 as shown in FIGS. 1–7 including the use of similar materials thereto, to insure a firm frictional grip and uniform nip pressure on sheet 25. Likewise, such an upper portion gripper pad may be used in place of, or and in addition to, the gripper pads shown in FIGS. 1–7.

Referring now to FIGS. 8–12, alternative embodiments to the sheet grippers shown and described in conjunction with FIGS. 1–7 are shown. Sheet gripper 184 may be substituted for sheet gripper 84 as shown in FIGS. 14 and 15 to thereby depict an alternative embodiment of the present invention.

FIGS. 8, 9 and 10A through 10C show an expandable gripper pad 250, capable of being inflated and deflated so as to selectively permit sheet gripper 184 to grasp and release sheet 25.

Figure 8:
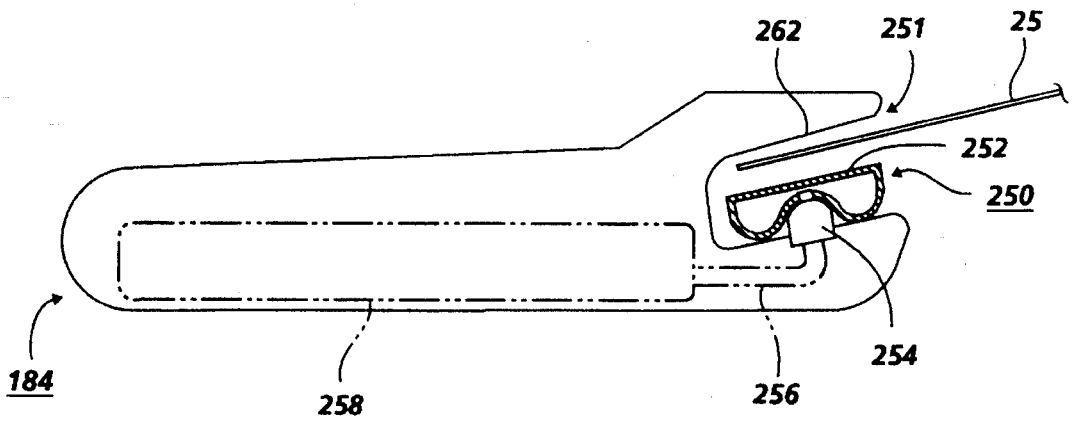
FIG. 8 is a side elevational view, partially in section, of a fluid inflatable gripping portion of a sheet gripper in an open position.
Figure 9:
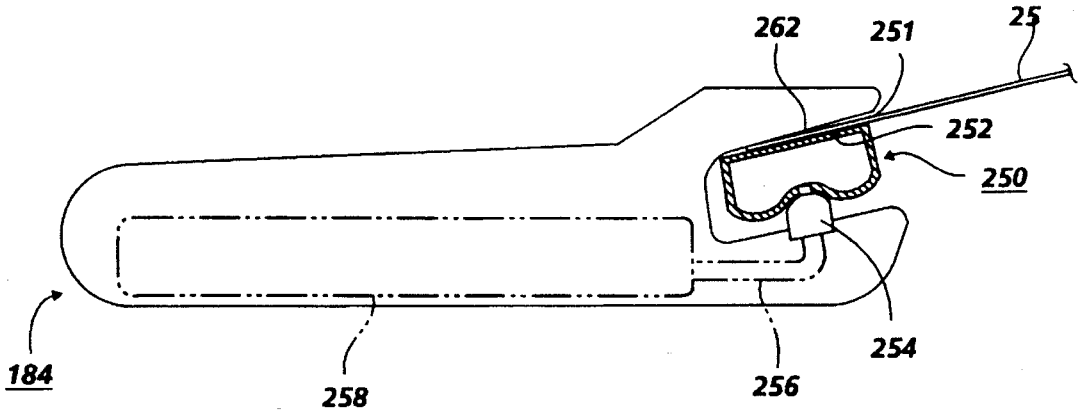
FIG. 9 is a side elevational view, partially in section, of a fluid inflatable gripping portion of a sheet gripper in a closed position and further showing a sheet being grasped by the sheet gripper.

FIG. 8 shows sheet gripper 184 in an actuated (open jaw) position, in which expandable gripper pad 250 is deflated so as to accept sheet 25 on opening 251. FIG. 9 shows sheet gripper 184 in an nonactuated (closed jaw) position, in which expandable gripper pad 250 is inflated so as to grasp sheet 25 on opening 251. As shown in FIGS. 8 and 9, expandable gripper pad 250 rests on base 254; as fluid is moved into and out of internal cavity 253 by electric pump unit 258 through tube 256, upper surface 252 is selectively moved in relation to plate 262. Pump unit 258 may be an electromechanical unit actuated by electronic timing or switching means, in which the electrical current required to deflate expandable gripper pad 250 is supplied only at the point or points in which sheet gripper 184 is to release its grip on sheet 25. In this manner, sheet gripper 184 grasps sheet 25 between plate 262 and upper surface 252 of expandable gripper pad 250 when internal cavity 253 is inflated with an increased volume of fluid, as shown in FIGS. 9 and 10B. Conversely, when a volume of fluid is removed from internal cavity 253, upper surface 252 of expandable gripper pad 250 is displaced from its gripping position on sheet 25 (as shown in FIGS. 8 and 10C). Alternatively, a mechanical pump may be used, so that expansion of gripper pad 250 may be achieved by a cam system in a manner similar to that shown and described in association with sheet gripper 284 in FIGS. 11 and 12.

Figure 10A:
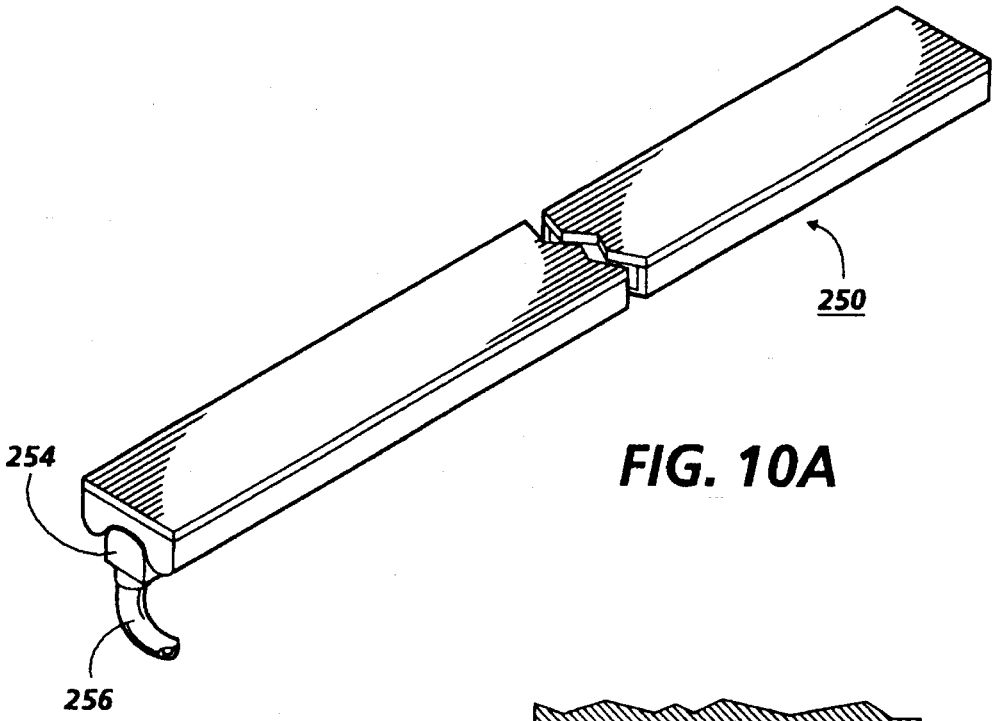
FIG. 10A is a perspective view of a fluid activated gripper pad as shown in FIG. 8 and 9.
Figure 10B:
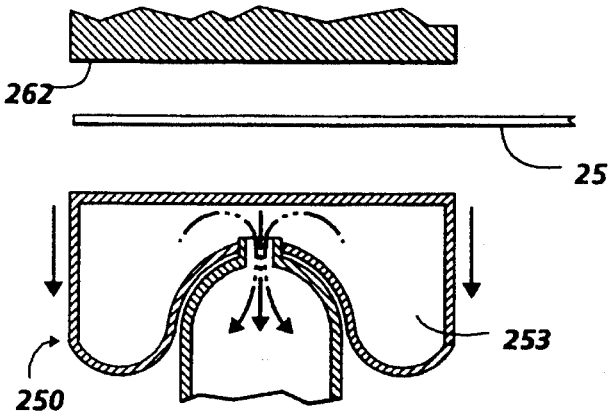
FIG. 10B is a partial side sectional, elevational view of a gripper pad in the open position.
Figure 10C:
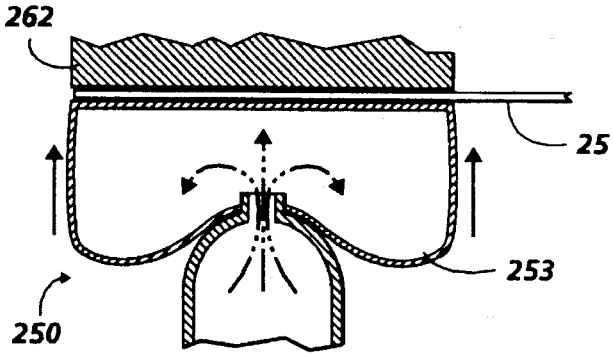
FIG. 10C is a partial side sectional, elevational view of a fluid inflatable gripping pad as shown in FIGS. 9, 10A and 10B.

FIG. 10A shows a perspective view of expandable gripper pad 250 alone. FIG. 10B shows an enlarged view of expandable gripper pad 250 in a deflated mode, so as to permit the release of sheet 25. FIG. 10C shows expandable gripper pad 250 in an inflated mode, so as to permit sheet gripper 184 to grasp sheet 25 between plate 262 and expandable gripper pad 250.

Figure 11:
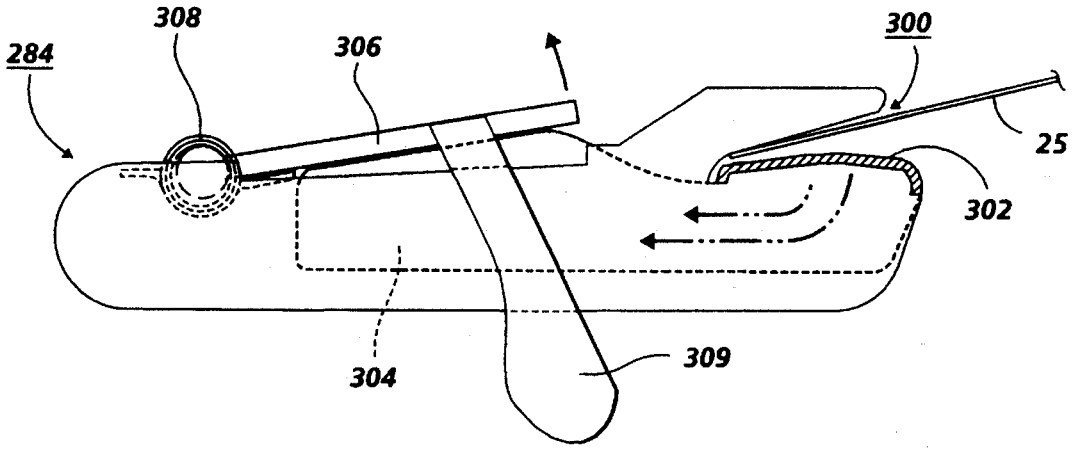
FIG. 11 is a side elevational view, partially in section, of the gripping portions of another embodiment of the sheet gripper used in a sheet transport apparatus with the sheet gripper shown in the open position and further showing a sheet positioned within the sheet gripper.
Figure 12:
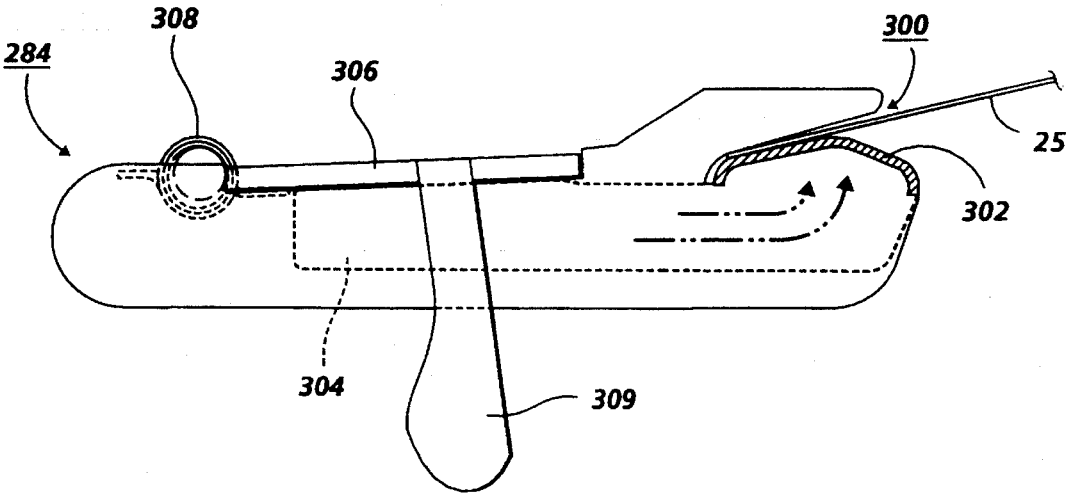
FIG. 12 is a side elevational view, partially in section, of the gripping portions of still another embodiment of the sheet gripper used in a sheet transport apparatus with the sheet gripper shown in the closed position and further showing a sheet positioned within the sheet gripper.

FIGS. 11 and 12 show an alternative embodiment (sheet gripper 284) to the sheet gripper embodiments 84 and 184 as shown in other Figures hereto. The elastomeric gripper contact surface 302 shown in FIGS. 11 and 12 is capable of being inflated and deflated so as to permit sheet gripper 284 grasp and release sheet 25. FIG. 11 shows sheet gripper 284 in which elastomeric gripper contact surface 302 is deflated, so as to permit slot 300 to accept sheet 25. FIG. 12 shows sheet gripper 284 in which elastomeric gripper contact surface 302 is inflated, so as to permit slot 300 to grasp sheet 25.

FIG. 11 shows sheet gripper 284 in an actuated (open jaw) position; as wall 306 of fluid bladder 304 is raised by the actuation of cam lever 309, gripper contact surface 302 is deflated according to the outward movement of wall 306 so as to permit sheet gripper 284 to accept sheet 25. In this manner, as one wall of fluid bladder 304 is mechanically manipulated, due to the constant internal volume of fluid bladder 304, gripper contact surface 302 is drawn inward so as to open slot 300. Wall 306 is normally biased by spring 308 in lowered position (as shown in FIG. 12). As cam lever 309 is permitted to drop into nonactuated position as shown in FIG. 11, gripper contact surface 302 is expanded outward, closing slot 300 so as to permit sheet gripper 284 to grip sheet 25. As gripper support member 310 is permitted to return to the nonactuated position (as shown in FIG. 12), elastomeric gripper contact surface 302 is inflated so as to close slot 300, thereby causing sheet gripper 284 to grasp sheet 25. Cam lever 309 thereby selectively pressurizes and depressurizes the fluid in bladder 304, resulting the application of uniform pressure along the entire nip by sheet gripper pad 302.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

I claim:

1. An apparatus for releasably gripping an edge area of a sheet, comprising:

a gripping member having opposed surfaces movably separable relative to one another to secure and release the edge area of the sheet; and an internally pressurized means, operatively associated with said gripping member, for applying a substantially uniformly distributed force along the edge area of the sheet in response to the sheet being secured by said gripping member.

2. The apparatus of claim 1, wherein said internally pressurized applying means comprises a resilient gripper pad secured to one of the surfaces of said gripping member.

3. The apparatus of claim 2, wherein said gripper pad is inflatable.

4. The apparatus of claim 3, wherein said inflatable gripper pad substantially spans an entire length of the edge of the sheet.

5. The apparatus of claim 3, wherein said inflatable gripper pad comprises a material selected from the group consisting of plastic, elastomeric polymer, synthetic rubber and natural rubber.

6. An apparatus for releasably gripping an edge area of a sheet, comprising:

a gripping member having opposed surfaces movable relative to one another to secure and release the edge area of the sheet; and an internally pressurized means, operatively associated with said gripping member, for applying a substantially uniformly distributed force along the edge area of the sheet in response to the sheet being secured by said gripping member, said internally pressurized applying means including an inflatable resilient gripper pad secured to one of the surfaces of said gripping member, wherein said inflatable gripper pad comprises a textured sheet gripping surface.

7. The apparatus of claim 3 wherein said inflatable gripper pad is filled with a fluid selected from the group consisting of a gas, a liquid, a gel, and a fluidized foam.

8. An apparatus for releasably gripping an edge area of a sheet, comprising:

a gripping member having opposed surfaces movable relative to one another to secure and release the edge area of the sheet;

an internally pressurized means, operatively associated with said gripping member, for applying a substantially uniformly distributed force along the edge area of the sheet in response to the sheet being secured by said gripping member, said internally pressurized applying means including an inflatable resilient gripper pad secured to one of the surfaces of said gripping member; and a sealed gripper tube secured to the other surface of said gripping member, said inflatable gripper tube being inflated with a fluid selected from the group consisting of a gas, a liquid, a gel and a fluidized foam, wherein said inflatable gripper tube cooperates with said inflatable gripper pad to grip the edge area of the sheet.

9. An apparatus for releasably gripping an edge area of a sheet, comprising:

a gripping member having opposed surfaces movable relative to one another to secure and release the edge area of the sheet;

an internally pressurized means, operatively associated with said gripping member, for applying a substantially uniformly distributed force along the edge area of the sheet in response to the sheet being secured by said gripping member, said internally pressurized applying means including an inflatable resilient gripper pad secured to one of the surfaces of said gripping member; and means for varying the internal pressure of said inflatable gripper pad so as to alter a gripping pressure on the sheet being secured by said gripping member.

10. The apparatus of claim 3, further comprising a pressure valve associated with said inflatable gripper pad to vary internal pressure of said inflatable gripper pad so as to alter the force on the sheet secured by said gripping member.

11. The apparatus of claim 3, further comprising a pump associated with said inflatable gripper pad to vary internal pressure of said inflatable gripper pad so as to alter the force on the sheet secured by said gripping member.

12. An apparatus for releasably gripping an edge area of a sheet, comprising:

a gripping member having opposed surfaces movable relative to one another to secure and release the edge area of the sheet; and an internally pressurized means, operatively associated with said gripping member, for applying a substantially uniformly distributed force along the edge area of the sheet in response to the sheet being secured by said gripping member, said internally pressurized applying means including an inflatable resilient gripping pad secured to one of the surfaces of said gripping member, wherein said inflatable gripper pad further includes a gripper wall opposed from the other surface of said gripping member and a pump, associated with said inflatable gripper pad, for releasably inserting a volume of fluid into the inflatable gripper pad to move said gripper wall so as to releasably grip the edge area of the sheet.

13. The apparatus of claim 7, wherein said inflatable gripper pad comprises:

a sheet gripper wall positioned opposed from and movable in relation to the other surface of said gripper member; and a volume displacing wall capable of moving the fluid in said inflatable gripper pad to move said sheet gripper wall in relation the other surface of said gripping member so as to releasably grip the edge area of the sheet.

14. The apparatus of claim 3, further comprising:

a cam; and a mechanical fluid pump, actuated by said cam, to vary pressure inside said inflatable gripper pad, whereby a wall of said inflatable gripper pad is moved in relation the other surface of said gripping member so as to releasably grip the edge area of the sheet.

15. An apparatus for releasably gripping an edge area of a sheet, comprising:

a gripping member having opposed surfaces movable relative to one another to secure and release the edge area of the sheet;

an internally pressurized means, operatively associated with said gripping member, for applying a substantially uniformly distributed force along the edge area of the sheet in response to the sheet being secured by said gripping member, said internally pressurized applying means including an inflatable resilient gripping pad secured to one of the surfaces of said gripping member; and an electric pump, associated with said inflatable gripping pad, to vary pressure inside the inflatable gripper pad, whereby a wall of said inflatable gripper pad is moved in relation the other surface of said gripping member so as to releasably grip the edge area of the sheet.

* * * * *